US005236132A

United States Patent [19]

Rowley, Jr.

[11] Patent Number: 5,236,132

[45] Date of Patent: Aug. 17, 1993

[54] GRADIENT-FORCE COMMINUTER/DEHYDRATOR APPARATUS AND METHOD

[75] Inventor: Frank F. Rowley, Jr., Valley Center, Kans.

[73] Assignee: Vortec, Inc., Valley Center, Kans.

[21] Appl. No.: 816,480

[22] Filed: Jan. 3, 1992

[51] Int. Cl.[5] ..... B02C 19/06

[52] U.S. Cl. ..... 241/5; 241/39; 34/12; 34/60

[58] Field of Search ..... 241/5, 39; 34/12, 60, 34/82, 57 R, 57 E, 58

[56] References Cited

U.S. PATENT DOCUMENTS

| | | | |
|---|---|---|---|
| 1,830,174 | 11/1931 | Peebles | 34/57 E X |
| 3,794,251 | 2/1974 | Williams | 241/81 X |
| 3,800,429 | 4/1974 | Lindl | 34/57 E X |
| 3,896,984 | 7/1975 | Edwards | 241/5 |
| 3,937,405 | 2/1976 | Stephanoff | 241/39 |
| 4,187,615 | 2/1980 | Iwata | 34/57 E X |
| 4,236,321 | 12/1980 | Palmonari et al. | 34/57 E |
| 4,304,360 | 12/1981 | Luhr et al. | 241/5 |
| 4,390,131 | 6/1983 | Pickrel | 241/1 |
| 4,478,862 | 10/1984 | Greethead | 34/57 E X |
| 4,505,051 | 3/1985 | Herchenbach et al. | 34/57 E |
| 4,532,155 | 7/1985 | Golant et al. | 34/57 E X |
| 4,736,527 | 4/1988 | Iwamoto et al. | 34/57 E |
| 4,756,093 | 7/1988 | Heinemann et al. | 34/57 R |
| 4,978,076 | 12/1990 | Andrews et al. | 241/5 |
| 5,012,619 | 5/1991 | Knepprath et al. | 241/39 X |
| 5,068,979 | 12/1991 | Wireman et al. | 34/58 |
| 5,102,055 | 4/1992 | Buschmann et al. | 241/5 |

*Primary Examiner*—Frank T. Yost
*Assistant Examiner*—Clark F. Dexter
*Attorney, Agent, or Firm*—Litman, McMahon & Brown

[57] ABSTRACT

An improved comminuter/dehydrator apparatus and method includes a body having an inverted, coaxially shaped cavity with an open truncated lower end and an open upper end connected to a cylindrically shaped chamber. A sleeve, which extends through the chamber and into the cavity, is adjustable axially by a pair of jacks. A damper is adjustable relative to the sleeve to control air escaping from the cavity into the ambient atmosphere. A manifold with a velocity-enhancing venturi mechanism directs air from a blower tangentially into the chamber to create cochleated and resonating, oscillatory cyclonic air-flow activity. A portion of the air from the blower to the chamber is diverted through a feeder containing the material being comminuted and dehydrated. The comminuted and dehydrated material is gravitationally discharged through the cavity lower end. The body has a removable nozzle tip to extend the operational characteristics of the apparatus. Finer materials being comminuted may be gravitationally directed into the cavity through a tube and elbow arrangement spaced below a slot and gate arrangement in the damper.

22 Claims, 2 Drawing Sheets

GRADIENT-FORCE COMMINUTER/DEHYDRATOR APPARATUS AND METHOD

BACKGROUND OF THE INVENTION

1. Field of the Invention

The present invention relates to an apparatus and a method for comminuting and dehydrating a variety of materials and, in particular, to an apparatus and method which produce comminuted and dehydrated materials by cyclonic pressure gradients through cochleated air-flow patterns.

2. Description of the Related Art

Numerous types of apparatuses and methods have been utilized to comminute materials having a variety of sizes, shapes, and physical characteristics, such as grains, ores, etc. Unfortunately, many of those apparatuses exhibited poor wearing characteristics and high maintenance problems, excessive noise generation, and high energy source requirements.

Similarly, numerous types of apparatuses and methods have been utilized to dehydrate various materials. Many of these apparatuses, in addition to many of the problems observed for the comminuters as aforesaid, exhibited heat generation and time consumption problems.

Various apparatuses have been developed in an attempt to utilize a destructive cyclonic environment for comminuting certain materials. For example, U.S. Pat. No. 4,390,131 discloses a method and apparatus for comminuting material, which utilizes three blowers: one for blowing air longitudinally into an inlet chamber and a frustoconical chamber, another for blowing air tangentially into a cylindrical chamber, and a third for assisting with discharging air entrained with the comminuted material. Unfortunately, all three blowers of this apparatus apparently must be simultaneously adjusted to select the desired throughput rate and coarseness of comminuted material.

What is needed is an apparatus and method which reliably and controllably harnesses the geostrophic relationship between air-flow velocity, pressure-gradient forces, and coriolis force, which are naturally present in the destructive, cyclonic environment of a tornado or cyclone, for practical purposes. Properly used, such destructive cyclonic forces can be harnessed for simultaneously comminuting or fractionating and dehydrating materials having a variety of sizes and physical characteristics and which utilizes the force of gravity such that a controlled cyclonic environment can be maintained by only one blower, thereby eliminating the complicated, interrelated adjustments normally required when using a plurality of blowers.

SUMMARY OF THE INVENTION

An improved comminuter/dehydrator apparatus and method are provided for comminuting and dehydrating a variety of materials having widely ranging sizes and physical characteristics.

The apparatus includes a cylindrically shaped chamber having a closed top, a closed side, an open bottom, and a vertically oriented axis; a body spaced below and connected to the chamber having an inverted, conically shaped cavity with an open base upper end dimensioned substantially similar to the inside dimensions of the chamber, an open truncated lower end, a detachable nozzle adapted to provide greater truncation of the cavity such that the operable range of material sizes and types is extended, and a vertically oriented axis co-linear with the axis of the chamber and which subtends an angle which operably generates a centrally located low pressure region in conjunction with cochleated air flow patterns to thereby comminute and dehydrate materials pneumatically suspended therein; a cylindrically shaped sleeve extending through the chamber and into the cavity and having an open upper end, an open frustoconically shaped flange at its lower end, a vertically oriented axis aligned with the axis of the cavity, and a pair of diametrically opposed jacks adapted to adjust the spacing of the sleeve relative to the cavity; an inverted, conically shaped damper adaptably mounted such that it is adjustable toward and away from the sleeve open end and having a cooperating slot and gate mechanism situated near lower extremities thereof, and a tube with a deflecting elbow spaced therebeneath for off-axis depositing of certain materials being comminuted directly into the cavity; a blower adapted to generate high volume, high velocity air flow; a manifold adapted to duct the air flow from the blower to the chamber such that the air flow is directed substantially tangentially into the chamber; a venturi mechanism adapter to enhance the velocity of the air flow as it enters the chamber; and a material feeder valve having a hopper, an output port connected to the manifold in close proximity to the chamber, and an input port connected to the blower such that a portion of the air flow is directed through the valve.

The method includes the steps of providing an apparatus substantially as hereinbefore described; activating the blower to cause air to flow through the manifold substantially tangentially into the chamber such that the air in the chamber and in the cavity are cyclonically pressurized; introducing the material being comminuted and dehydrated into the apparatus; adjusting the spacing of the sleeve relative to the cavity and the spacing of the damper relative to the sleeve such that the desired rate of comminuting and dehydrating the material is selected and the desired coarseness of the comminuted material is selected by interaction between a centrally located low pressure region and cochleated air-flow patterns in the cavity; and gravitationally discharging the comminuted and dehydrated material from the apparatus.

Principal Objects and Advantages of the Invention

Therefore, the principal objects and advantages of the present invention include: to provide an apparatus and a method which simultaneously comminute and dehydrate a variety of materials; to provide such an apparatus which, except for a blower and a material feeder, has no operably moving parts; to provide such an apparatus and method which comminutes a variety of materials by the use of a single blower; to provide such a method and apparatus in which the comminuted material is discharged gravitationally; to provide such an apparatus and method which will accommodate materials having a variety of different sizes; to provide such an apparatus and method to accommodate a variety of different materials having different physical characteristics; to provide such an apparatus which is portable; and to generally provide such an apparatus which is efficient and reliable, relatively economical to manufacture, and which generally performs the requirements of its intended purposes.

Other principal objects and advantages of this invention will become apparent from the following description taken in conjunction with the accompanying drawings wherein are set forth, by Way of illustration and example, certain embodiments of this invention.

The drawings constitute a part of this specification and include exemplary embodiments of the present invention and illustrate various objects and features thereof.

DETAILED DESCRIPTION OF THE INVENTION

Figures 1, 2, 3:
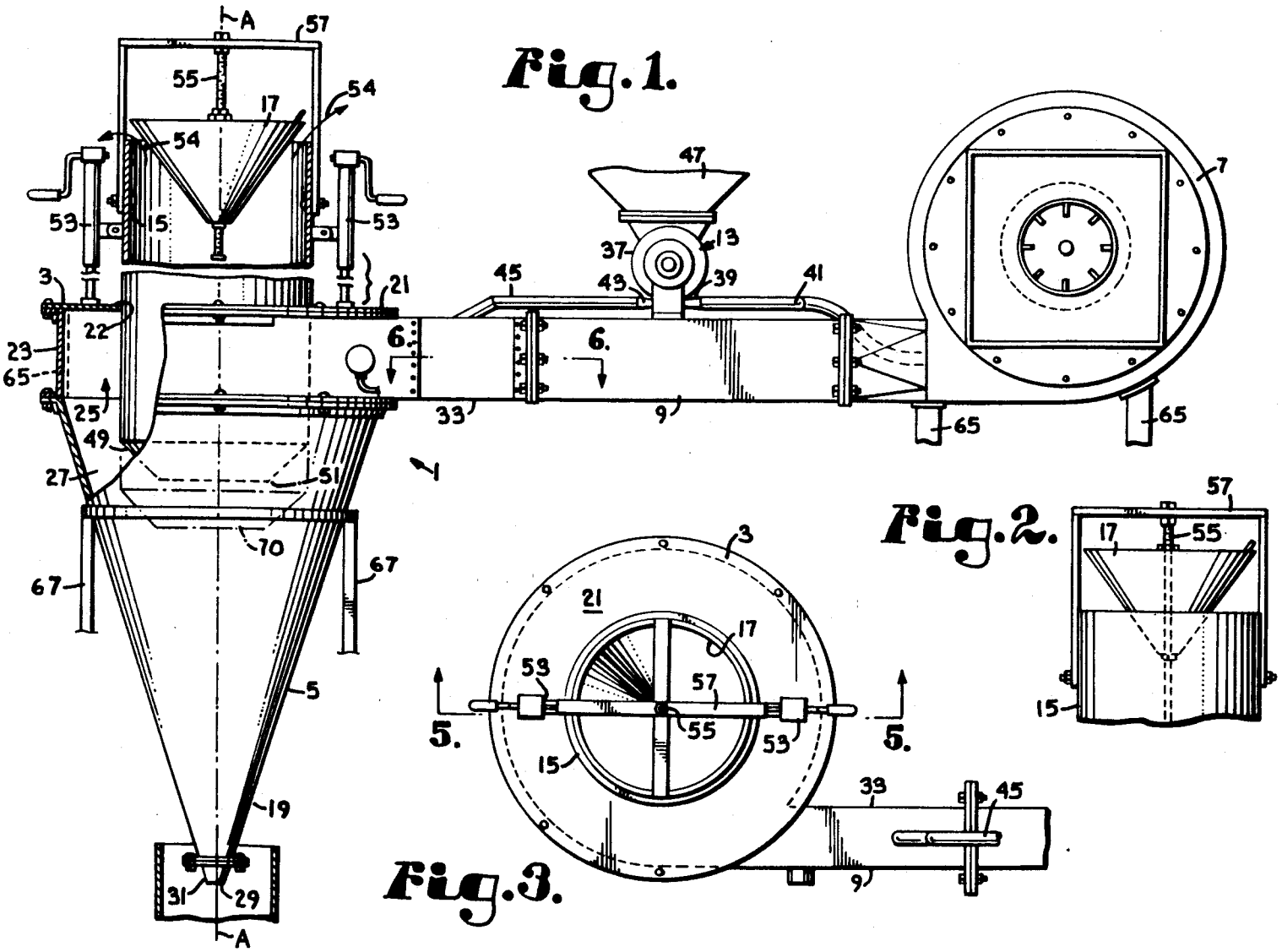
FIG. 1 is a fragmentary, side elevational view of a gradient-force comminuter/dehydrator apparatus, with portions cut away to reveal details thereof, according to the present invention.
FIG. 2 is a fragmentary view of the gradient-force comminuter/dehydrator apparatus, showing a damper thereof.
FIG. 3 is a fragmentary, top plan view of the damper of the gradient-force comminuter/dehydrator apparatus.
Figure 4:
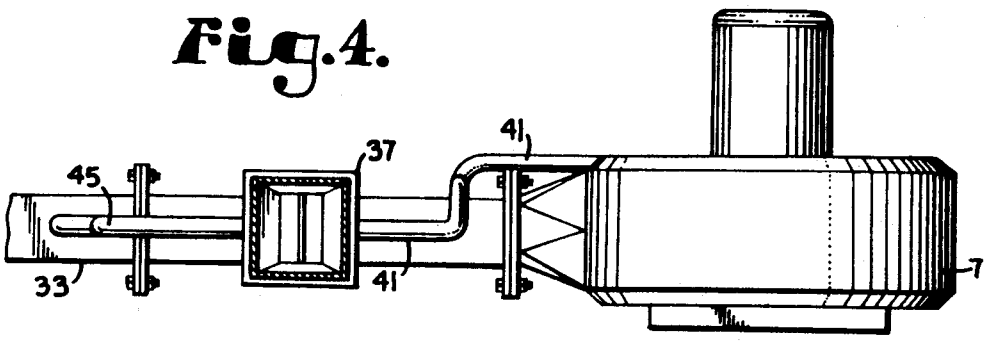
FIG. 4 is a fragmentary, top plan view of a material feeder valve connected to a blower and a manifold of the gradient-force comminuter/dehydrator apparatus.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a gradient-force comminuter/dehydrator apparatus for comminuting a variety of different materials having various sizes and various physical characteristics, in accordance with the present invention, as shown in FIGS. 1 through 8. The apparatus 1 comprises a cylindrical chamber 3, a body 5, pressurizing means such as a blower 7 and ducting means 9, air velocity enhancing means such as a venturi mechanism 11, material introducing means 13 for introducing material being comminuted into the apparatus 1, comminuting rate control means and coarseness control means for controlling the rate of comminution of the material being comminuted and the coarseness of the comminuted material such as a sleeve 15 in conjunction with a damper 17, and gravitational discharge means 19 for utilizing gravity to discharge the comminuted material from the apparatus 1.

The cylindrical chamber 3 has a closed, annularly shaped top 21 having a centrally spaced orifice 22, a closed side 23, an open bottom 25, and a generally vertically oriented axis AA, as shown in FIG. 1.

The body 5 has an inverted, conically shaped cavity 27 with base dimensions substantially similar to the inside dimensions of the chamber 3. Since the body 5 is inverted, the "base" refers to the topmost portion in FIGS. 1 and 5, i.e. the portion which mates with the chamber 3. The body 5 has a truncated lower end 29 and a generally vertically oriented axis which is substantially colinear with the axis of the chamber 3. The body 5 is connected to and suspended generally below the chamber 3. For some applications, the body 5 has a detachable nozzle 31, the removal of which provides greater truncation of the conically shaped body 5. Preferably, the conically shaped cavity 27 subtends an angle, as indicated by the arrow designated by the numeral 32 in FIG. 5, within the range of 28° to 42°. More preferably, the cavity 27 subtends an angle of approximately 36°.

The blower 7, such as a Model 602A Pressure Blower as provided by Garden City Fan & Blower Company, provides air at high volume and high velocity. The ducting means 9 include a manifold 33 for connecting the blower 7 to the chamber 3. In one application of the present invention, the manifold 33 had dimensions of 6½-inches width and 9-inches height. For example, air flow of approximately 1000–8000 cfm may be used while maintaining a static pressure of approximately 3–50 inches.

The manifold 33 is connected to the chamber 3 such that air being forced therethrough into the chamber 3 is generally directed substantially tangentially into the chamber 3. To maintain consistency with natural forces, the air is introduced into the chamber 3 such that the air spirals in a clockwise direction as viewed downwardly.

The venturi mechanism 11 generally includes a pair of opposing, arcuately shaped sidewall plates 34 spaced within the manifold 33 such that a throat 35 is formed therebetween. In one application of the present invention, the throat 35 had a width of approximately 3½ inches. The venturi mechanism 11 is generally spaced in close proximity to the chamber 3.

The material introducing means 13 may include a valve 37, such as a Model VJ8x6 Airlock Valve as provided by Kice Industries, Inc. An input port 39 of the valve 37 is connected to the blower 7 by an upstream pipe 41 such that a portion of the pressurized air being transferred from the blower 7 to the chamber 3 is routed through the valve 37. An output port 43 of the valve 37 is connected to the manifold 33 by a downstream pipe 45 such that material being comminuted and dehydrated by the apparatus 1 is generally directed into the manifold 33 either at, or downstream from, the venturi mechanism 11. A hopper 47 is mounted on the valve 37 such that material being comminuted is gravitationally fed into the valve 37.

The sleeve 15 is generally cylindrically shaped and has an outside diameter dimensioned slightly smaller than the dimensions of the orifice 22. The sleeve 15 extends axially through the chamber 3 and extends into the cavity 27 spaced therebelow. The sleeve 15 includes a truncated, conically shaped flange 49 which has an open lower end 51.

Elevating means, such as a pair of jacks 53 spaced diametrically across the sleeve 15 and generally above the chamber 3, are adapted to cooperatively, axially adjust the sleeve 15 relative to the chamber 3 and the cavity 27.

The damper 17 is adapted to selectively restrict air flowing through the sleeve 15 from the cavity 27 into the ambient atmosphere, as indicated by the arrows designated by the numeral 54 in FIG. 1. The damper 17 is generally threadably mounted on a vertically oriented threaded rod 55 connected to a bracket 57 which is connected to the sleeve 15, as shown in FIGS. 1 and 2, such that the damper 17 is adjustable toward and away from the sleeve 15. Preferably, the damper 17 is configured as an inverted cone. In one application of the present invention, the conically shaped damper 17 encompasses an angle of approximately 70°.

The damper 17 generally has slots 59 near the lower extremity thereof. A gate mechanism 61 is adapted to selectively open and close the slots 59 such that selected material being comminuted can pass therethrough. A discharge tube 63 is detachably connected to the damper 17 such that material falling through the slots 59 is gravitationally introduced directly into the cavity 27 as hereinafter described.

In one application of the present invention, the apparatus 1 includes turbulence-enhancing means comprising a plurality of ribs 65. Each of the ribs 65 is generally elongate, with a length approximately equal to the axial length of the chamber 3 and has a roughened surface. The ribs 65 are parallelly spaced apart along the inner perimeter of the chamber 3. Frame means 67 are provided as needed to maintain the various portions of the apparatus 1 in their relative positions and for mounting on a trailer (not shown) for portability, if desired.

In an application of the present invention, the blower 7 is activated such that high volume, high velocity air is introduced substantially tangentially into the chamber 3 whereby that air is further pressurized, cyclonically, in the chamber 3 and in the cavity 27. Due to the centrifugal forces present in the cyclonic environment, the pressure nearer the outer extremities of the cavity 27 is substantially greater than atmospheric pressure, while the pressure nearer the axis of the cavity 27 is less than atmospheric pressure.

Figure 5:
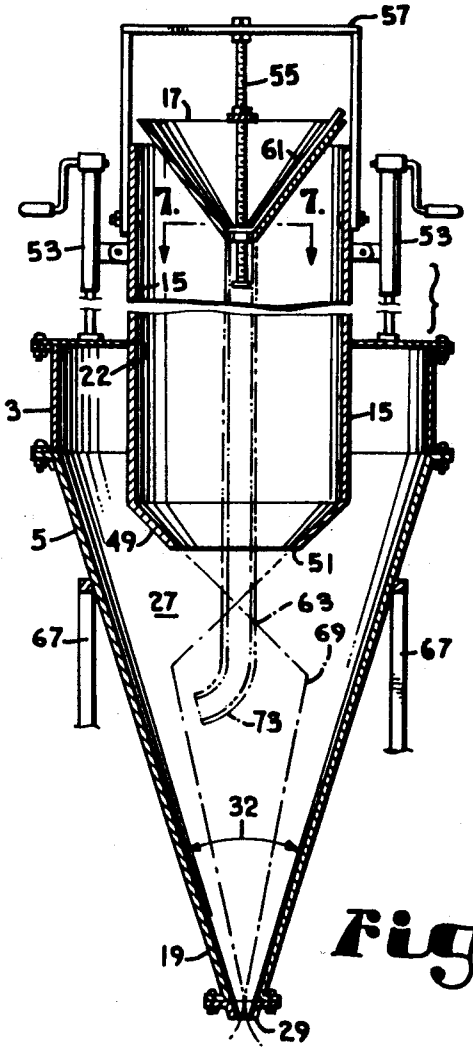
FIG. 5 is a fragmentary, cross-sectional view of the gradient-force comminuter/dehydrator apparatus, taken generally along line 5—5 of FIG. 3.

A profile line, designated by the dashed line designated by the numeral 69 in FIG. 5, indicates the approximate boundary between the region of the cavity 27 having pressures above atmospheric pressure from the region of the cavity 27 having pressures below atmospheric pressure. The pressure-gradient and coriolis forces across and the collision interaction between particles contained in the high-velocity cyclonically pressurized air are violently disruptive to the physical structure of those particles, thereby comminuting and generally dehydrating them.

As the sleeve 15 is lowered by adjusting the jacks 53, as indicated by the phantom lines designated by the numeral 70 in FIG. 1, the profile line 69 moves radially outwardly, providing greater cyclonic velocities and force gradients. Thus, vertical adjustment of the sleeve 15 allows the apparatus 1 to be adapted to accommodate materials having widely different physical characteristics.

The lower the sleeve 15 is spaced relative to the cavity 27, the smaller the combined total volume of the chamber 3 and the body 5 which is available for air circulation. Since the volume of air being introduced remains constant, this reduction in volume causes a faster flow of air, causing a greater cyclonic effect throughout the body 5 and consequently causing the material being comminuted to circulate longer in the chamber 3 and the body 5. The increased cyclonic flow also increases the vacuum effect which generates the suction near the vortex of the open lower end 29, as indicated by the arrow 71 in FIG. 8, causing generally vertical, cochleating and resonating, oscillatory patterns in the air flow containing the material being comminuted to be more violent and thereby affecting the coarseness of the comminuted material. For some applications and configurations of the apparatus 1, the air flow indicated by the numeral 71 may only be nominal.

Similarly, adjusting the damper 17 relative to the sleeve 15, which controls the volume of air allowed to escape from the center, low-pressure region of the cavity 27 into the ambient atmosphere, affects the cyclonic velocities, force gradients, and vertical oscillations as the apparatus 1 is adjusted to handle various throughput volumes of materials being comminuted.

The throughput rate for comminuting the material is controlled by adjusting the rate and manner in which material is being fed into the apparatus 1. If the material is to be both comminuted and dehydrated, then the material is generally fed into the apparatus 1 by the valve 37. In that event, the gate mechanism 61 may be used as a fine control for the coarser adjustments of the damper 17 relative to the sleeve 15.

If the material is relatively fine, such as wheat and the like, and is to be largely comminuted and only minimally dehydrated, then the material may be fed into the apparatus 1 by the damper 17 and the gate mechanism 61 in cooperation with the slots 59. In that event, the material being comminuted falls through the slots 59 and drops gravitationally downwardly through the discharge tube 63 where an elbow 73 injects the material directly into the high cyclonic pressure region of the cavity 27.

Figure 8:
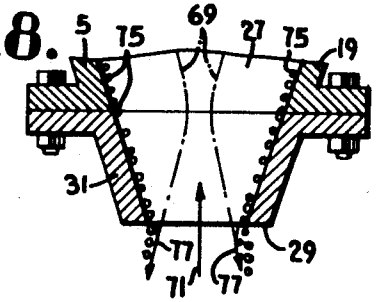
FIG. 8 is an enlarged and fragmentary, partially schematic, cross-sectional view of a nozzle of the gradient-force comminuter/dehydrator apparatus, according to the present invention.
Figure 7:
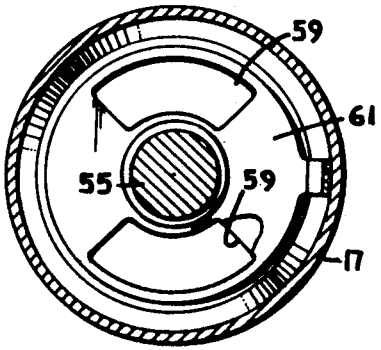
FIG. 7 is an enlarged and fragmentary, top plan view of a gate mechanism of the gradient-force comminuter/-dehydrator apparatus with portions cut away to reveal details thereof, taken generally along line 7—7 of FIG. 5.
Figure 6:
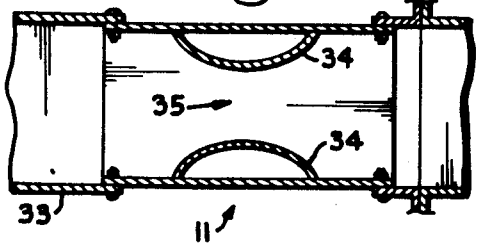
FIG. 6 is a fragmentary, cross-sectional view of a venturi mechanism of the gradient-force comminuter/-dehydrator apparatus, taken generally along line 6—6 of FIG. 1.

As the material is comminuted, the finer particles thereof tend to diffuse to the conical perimeter of the cavity 27, as indicated by the numeral 75 in FIG. 8. As those finer particles accumulate, they tend to move gravitationally downwardly to the open lower end 29 where the particles exit from the apparatus 1, assisted by the annularly shaped air leakage from the cyclonically higher pressure region along the perimeter of the cavity 27, as indicated by the arrows designated by the numeral 77 in FIG. 8. By continually feeding material into the apparatus 1, a continuous throughput of comminuted material is provided.

By selectively utilizing the apparatus with and without the nozzle 31, a greater range of sizes and types of materials, and greater throughput rates are obtainable with the apparatus 1

A container, conveyor belt or other suitable arrangement (not shown) spaced below the lower end 29 receives the comminuted material as it is gravitationally discharged from the apparatus 1.

It is to be understood that while certain forms of the present invention have been illustrated and described herein, it is not to be limited to the specific forms or arrangement of parts described and shown.

What is claimed and desired to be secured by Letters Patent is as follows:

1. An apparatus for comminuting and dehydrating material, comprising:

(a) a cylindrical chamber having a diameter and a generally vertically oriented axis;

(b) a body having an inverted, conically shaped cavity with a generally vertically oriented axis and with an open truncated lower end; said body connected to, and suspended below, said chamber; said cavity having a base which connects to said chamber wherein at said connection said base has a diameter substantially equal tot he diameter of said chamber;

(c) air flow means for causing air to flow through said apparatus;

(d) first material introduction means for introducing material to be comminuted and dehydrated into said apparatus;

(e) second material introducing means for introducing material to be comminuted and dehydrated into said apparatus including first controlling means comprising a cylindrically shaped sleeve axially extending through said chamber and partially through said cavity and second controlling means comprising dampening means located at least partially within said sleeve for dampening air flowing through said sleeve; and (f) gravitational discharge means for gravitationally discharging the comminuted material from said apparatus.

2. The apparatus according to claim 1, said first material introduction means includes:

(a) a material feeding valve having an input port connected to said blower and an output port connected to said duct such that a portion of said air being provided to said chamber by said blower is operably routed through said valve.

3. The apparatus according to claim 1, wherein:

(a) the open truncated lower end of said conically shaped cavity encompasses an angle within the range of approximately 28° to 42°.

4. The apparatus according to claim 3, wherein: said angle is approximately 36°.

5. The apparatus according to claim 1, wherein:

(a) said body has a detachable nozzle such that greater truncation of said body is provided.

6. The apparatus according to claim 1, wherein:

(a) said dampening means includes a damper which is adjustable toward and away from said sleeve.

7. The apparatus according to claim 6, wherein:

(a) said damper is configured as an inverted cone.

8. The apparatus according to claim 7, wherein:

(a) said damper includes at least one slot and a gate situated near a lower portion of said damper; said gate is operably connected to said damper to selectively open and close said slot.

9. The apparatus according to claim 8, including:

(a) a tube extending from said damper receive the material from said damper; said tube further adapted to inject the material off-axis into said cavity.

10. The apparatus according to claim 1, wherein:

(a) said air flow means include:

(1) a blower; and (2) ducting means for ducting air from said blower to said chamber; said ducting means including a manifold connecting said blower to said chamber.

11. The apparatus according to claim 10, wherein:

(a) said manifold is connected to said chamber such that said ducted air is directed generally tangentially into said chamber.

12. The apparatus according to claim 10, wherein:

(a) said manifold includes a venturi mechanism which is adapted to partially restrict cross-sectional dimensions of said manifold such that the velocity of air being introduced into said chamber is enhanced thereby; said venturi mechanism is spaced in close proximity to said chamber.

13. The apparatus according to claim 12, wherein:

(a) said body has a detachable nozzle.

14. The apparatus according to claim 1, further including:

(a) turbulence enhancing means for enhancing turbulence in said chamber.

15. The apparatus according to claim 14, wherein:

(a) said turbulence enhancing means includes a plurality of parallel ribs spaced apart along an inner surface of said chamber.

16. The apparatus according to claim 15, wherein:

(a) said ribs have roughened surfaces.

17. The apparatus according to claim 1 wherein:

(a) said air flow means include a single blower.

18. A gradient-force comminuter/dehydrator apparatus for comminuting and dehydrating material, comprising:

(a) a cylindrical chamber having a partially closed planar top wall, a closed peripheral side wall, and an open bottom; said chamber having a diameter and a generally, vertically oriented axis;

(b) a body having an inverted, conically shaped cavity with an open base upper end and an open truncated lower end; said cavity having a generally, vertically oriented axis; said base upper end having a diameter substantially equal to the diameter of said chamber; the open truncated lower end of said cavity encompassing an angle of approximately 36 degrees; the base upper end of said body connected to and positioned below said chamber such that said axis of said cavity is substantially colinear with said axis of said chamber;

(c) a blower adapted to operably provide high volume, high velocity air to said chamber and said cavity;

(d) a manifold connecting said blower to said chamber to duct said air from said blower to said chamber and said cavity; said manifold aligned with said chamber such that said ducted air is directed substantially tangentially into said chamber;

(e) a material feeder value adapted to feed the material being comminuted and dehydrated into said apparatus; said valve having an output port connected to said manifold in close proximity to said chamber and an input port connected to said blower such that a portion of said air flowing from said blower to said chamber flows through said valve;

(f) a cylindrically shaped sleeve having a generally, vertically oriented axis; said sleeve having an open upper end and an open lower end; said sleeve extending through said chamber and into said cavity; said sleeve having a pair of jacks such that said sleeve is vertically adjustable relative to said chamber such that said axis of said sleeve is substantially colinear with said axis of said chamber;

(g) a damper having an inverted, conically shaped configuration; said damper having a generally, vertically oriented axis; said damper threadably connected to said sleeve such that the axis of said damper is substantially co-linear with said axis of said sleeve; said damper adapted to be threadably advanceable toward and away from said open upper end of said sleeve in order to interact with air operably exiting from said cavity into the ambient atmosphere through said sleeve; and (h) a venturi mechanism having an opposing pair of arcuately shaped sidewall plates such that the velocity of air flowing therebetween is enhanced; said venturi mechanism spaced internally to said manifold and in close proximity to said chamber.

19. A method for comminuting and dehydrating material, comprising the steps of:

(a) providing an apparatus having:

(1) a cylindrical chamber having a diameter and a generally vertically oriented axis;

(2) a body having a inverted, conically shaped cavity with a generally vertically oriented axis and with an open truncated lower end; said body connected to, and suspended below, said chamber; said cavity having a base wherein at said connection, said base has a diameter substantially equal to the diameter of said chamber;

(3) air flow means for causing air to flow through said apparatus;

(4) first material introduction means for introducing material to be comminuted and dehydrated into said apparatus;

(5) second material introducing means for introducing material to be comminuted and dehydrated into said apparatus including:

(A) first controlling means for controlling the rate of comminuting the material, said first controlling means including a cylindrically shaped sleeve extending through said chamber; and (B) second controlling means for controlling the coarseness of the comminuted material, said second controlling means comprising dampening means located at least partially within said sleeve; and (6) gravitational discharge means for gravitationally discharging the comminuted material from said apparatus;

(b) causing air from said air flow means to cyclonically flow through said chamber and said cavity;

(c) introducing material into said apparatus and comminuting and dehydrating said material;

(d) adjusting said first and second controlling means to select the desired rate of comminuting the material and to select the desired coarseness of the comminuted material, respectively; and (e) gravitationally discharging comminuted material from said apparatus.

20. An apparatus for comminuting and dehydrating material, comprising:

(a) a cylindrical chamber having a diameter and a generally vertically oriented axis;

(b) a body having an inverted, conically shaped cavity with a generally vertically oriented axis and with an open truncated lower end; said body connected to, and suspended below, said chamber; said cavity having a base which connects to said chamber wherein at said connection said base has a diameter substantially equal to the diameter of the chamber;

(c) air flow means for causing air to flow through said apparatus;

(d) first material introduction means for introducing material to be comminuted and dehydrated into said apparatus;

(e) second material introducing means for introducing material being comminuted and dehydrated into said apparatus including first controlling means comprising a cylindrically shaped sleeve axially extending through said chamber and partially through said cavity and second controlling means comprising dampening means located at least partially within said sleeve for dampening air flowing through said sleeve, said dampening means being configured as an inverted cone; and (f) gravitational discharge means for gravitationally discharging the comminuted material from said apparatus.

21. The apparatus according to claim 23, wherein:

(a) said dampening means includes at least one slot and a gate situated near a lower portion of said dampening means; said gate operably connected to said dampening means to selectively open and close said slot.

22. The apparatus according to claim 21, including:

(a) a tube extending from said dampening means to receive the material from said dampening means; said tube further adapted to inject the material off-axis into said cavity.

* * * * *